United States Patent [19]

Kosteck

[11] Patent Number: 4,805,536

[45] Date of Patent: Feb. 21, 1989

[54] SEMI-WADCUTTER BULLET AND METHOD OF MANUFACTURING SAME

[75] Inventor: Gregory R. Kosteck, Godfrey, Ill.

[73] Assignee: Olin Corporation, Stamford, Conn.

[21] Appl. No.: 128,320

[22] Filed: Dec. 3, 1987

[51] Int. Cl.[4] ..... F42B 11/08

[52] U.S. Cl. ..... 102/514; 29/123

[58] Field of Search ..... 102/514, 530, 532; 29/1.23, 1.2

[56] References Cited

U.S. PATENT DOCUMENTS

| | | | |
|---|---|---|---|
| 286,387 | 10/1883 | Clark | 102/514 |
| 680,550 | 8/1901 | Smith | 29/1.23 |
| 3,142,256 | 7/1964 | Mack | 102/514 |
| 4,503,777 | 3/1985 | Young | 102/514 |
| 4,517,898 | 5/1985 | Davis | 102/514 |

*Primary Examiner*—Donald P. Walsh
*Attorney, Agent, or Firm*—Bruce E. Burdick

[57] ABSTRACT

A semi-wadcutter bullet useful for target practice includes a lead core partially contained and locked in a metal cup-shaped jacket. The lead core has a cylindrical body, a frusto-conical nose formed integral with the body and extending forwardly therefrom, and a forward-facing annular ledge formed on the body and surrounding a base of the nose. The metal jacket has a cylindrical sidewall with an annular rim portion thereon. The core body is seated within the jacket sidewall with the core nose protruding thereabove. The rim portion of the jacket sidewall is bent into overlying relation with the ledge on the core body so as to lock the jacket on the core body and define a forwardly-facing sharp profile for making clean cut holes in the target paper. The semi-wadcutter bullet is manufactured first by inserting and seating the core into jacket such that the core body is surrounded by the jacket sidewall up to the ledge on the body and the sidewall rim portion extends slightly above the core body and along the core nose. Then the core nose and jacket sidewall rim portion are deformed respectively to form an annular ledge on the core body surrounding the core nose and to bend the sidewall rim portion into overlying relation with the ledge on the core body locking the jacket on the core body and defining the sharp corner profile on the jacket.

10 Claims, 1 Drawing Sheet

SEMI-WADCUTTER BULLET AND METHOD OF MANUFACTURING SAME

BACKGROUND OF THE INVENTION

1. Field of the Invention

The present invention relates generally to ammunition for target practice and, more particularly, is concerned with a semi-wadcutter bullet capable of making clean holes in target paper during shooting practice and with a method of manufacturing the bullet.

2. Description of the Prior Art

Law enforcement personnel, sportsmen and others typically engage in target practice at firing ranges on a frequent basis to maintain their skills in shooting accuracy. One type of ammunition used for target practice rounds is a semi-wadcutter bullet. Such type of bullet ordinarily has a long cylindrical body and a short frustoconical. nose merging with the front end of the body at a generally radially-extending annular ledge. Semi-wadcutter bullets predominantly are composed of lead only, although such type of bullet has been produced heretofore with a short jacket encompassing a lower portion of the lead body and spaced below the annular ledge.

Marginal accuracy and excessive barrel leading and excessive airborne lead are well known concerns of all-lead semi-wadcutter bullets in high velocity applications. Accuracy of the lead bullet is adversely affected by vaporization of portions of the rear end of the bullet body, resulting from ignition of the propellant charge. Such destruction of rear end portions of the bullet distorts the symmetrical configuration thereof which is requisite for accurate flight. Undesired leading of the barrel occurs due to radial expansion of the bullet as it accelerates down the barrel.

Radial expansion of the lead bullet also can adversely impact the scores which can be attained by the target practice participants Bullet expansion tends to degrade or destroy the sharpness of the profile of the annular ledge which determines the quality of the hole made in the target paper by the bullet. For example, radial expansion can cause rounding of the ledge which results in the bullet making tears in the target paper rather than clean cut holes. Target tears make it difficult to identify closely spaced bullet holes and to score bullet holes that are close to the various lines on the target. oftentimes resulting in a reduction of the score.

In an attempt to improve the above-described deficiencies of some current lead semi-wadcutter bullets, several additional costly operations, i.e., gas checks and rehitting, are required to produce such bullets with acceptable performance. A gas check operation refers to placing a short (brass) cup over the base of a lead bullet in order to obturate the bullet heel. Gas check bullets do not eliminate airborne lead due to the lead-barrel interface occurring during in bore acceleration. The gas check tends to scrap bore clean and expel the lead into the atmosphere, thus, creating airborne lead, semi-jacketed bullets would result the same phenomenon. A rehit operation refers to returning bullet component to bullet assembly press after supplementary operations are performed, (i.e. knurling).

Consequently, a need exists for a new semi-wadcutter bullet which will overcome concerns with accuracy and leading raised by bullets manufactured heretofore and for a method of manufacture which will render such new bullet cost effective.

SUMMARY OF THE INVENTION

The present invention provides a semi-wadcutter bullet and method of manufacturing the same which are designed to satisfy the aforementioned needs. The semi-wadcutter bullet design of the present invention combines a lead projectile having a body, nose and generally radially-extending annular ledge with a metal cup-shaped jacket which encloses the body up to and including the ledge. The upper rim of the jacket is bent over and radially inward to define a sharp profile for making clean cut holes in the target paper and to lock the jacket onto the bullet core. The jacket provides a rigid, lead-free bearing surface and promotes uniform upsetting in an upsetting application such as a hollowpoint design.

Furthermore, the bullet eliminates the need for knurling, lubrication and rehit/sizing operations, avoids gas cutting and lead spitting, reduces barrel leading, produces less airborne contamination and provides an excellent bearing surface which improves accuracy. Also, the bullet manufacturing method of the present invention involves a sequence of simple, less costly steps which make the bullet more cost effective to produce and superior with respect to leading and accuracy and airborne lead than currently produced bullets.

Accordingly, the present invention is directed to a semi-wadcutter bullet, comprising: (a) a lead core having a cylindrical body, a conical nose being formed integral with the body and extending forwardly therefrom, and a forward-facing annular ledge formed on the body and surrounding a base of the nose; and (b) a metal cup-shapsd jacket having a cylindrical sidewall with an annular rim portion thereon. The core body is seated within the jacket sidewall with the core nose protruding thereabove. The rim portion of the jacket sidewall is bent into overlying relation with the ledge on the core body so as to lock the jacket to the core body and define a forwardly-facing sharp corner between the sidewall rim portion and the remainder of the jacket sidewall.

Also, the present invention is directed to a method of manufacturing a semi-wadcutter bullet, comprising the steps of: (a) inserting a lead core into a metal jacket such that a body of the core is surrounded by a continuous sidewall of the jacket so as to define an annular gap therebetween and such that a conical nose of the core being integral with the core body protrudes beyond a rim portion of the jackat sidewall; (b) seating the core body within the jacket sidewall so as to cause an expansion of the core body in diameter which fills the gap and a reduction of the core body in height to slightly below that of the jacket sidewall which projects the rim portion thereof slightly beyond the core body and along the core nose; (c) deforming the core nose so as to cause a reduction of the core body in diameter which forms an annular ledge on the core body surrounding the core nose; and (d) deforming the jacket sidewall rim portion so as to cause a bending of the sidewall rim portion into overlying relation with the ledge on the core body which locks the jacket on the core body and defines a forwardly-facing sharp corner between the rim portion and the remainder of the jacket sidewall.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
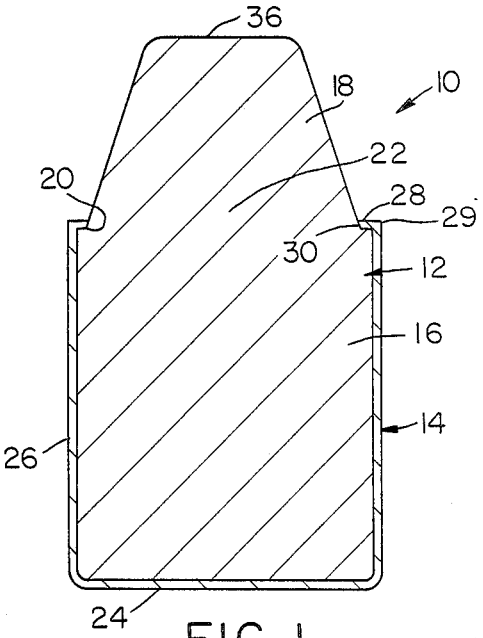
FIG. 1 is a longitudinal sectional view of a semi-wadcutter bullet constructed in accordance with the present invention.

Referring now to the drawings, and particularly to FIG. 1, there is illustrated a semi-wadcutter bullet useful for target practice, being constructed in accordance with the present invention and generally designated by the number 10. Basically, the semi-wadcutter bullet 10 includes a core 12, such as composed of lead, and a metal cup-shaped jacket 14, such as composed of brass, which partially encloses and is locked to the core 12.

More particularly, the lead core 12 has a body 16, nose 18 and annular ledge 20. The body 16 is generally cylindrical shaped, and the nose 18 formed integral therewith is frusto-conical shaped. The ledge 20 is formed on the body 16 in a forward-facing orientation and surrounds a base 22 of the nose 18 so as to extend generally radially outward therefrom.

The metal cup-shaped jacket 14 encloses the core body 16 up to and including the annular ledge 20. The jacket has a flat circular base 24 and continuous cylindrical sidewall 26 integral formed with the base 24 and having an outer annular rim portion 28. The lead core body 16 is seated within the jacket sidewall 26 such that the conical core nose 18 protrudes outwardly thereabove. The rim portion 28 of the jacket sidewall 26 is bent and extends radially inward into overlying relation with the annular ledge 20 on the core body 16 so as to lock the jacket 14 on the core body 16 and form a forwardly-facing sharp corner 29 between the sidewall rim portion 28 and the remainder of the jacket sidewall 26 which defines a sharp profile for making clean cut holes in target paper.

Figure 2:
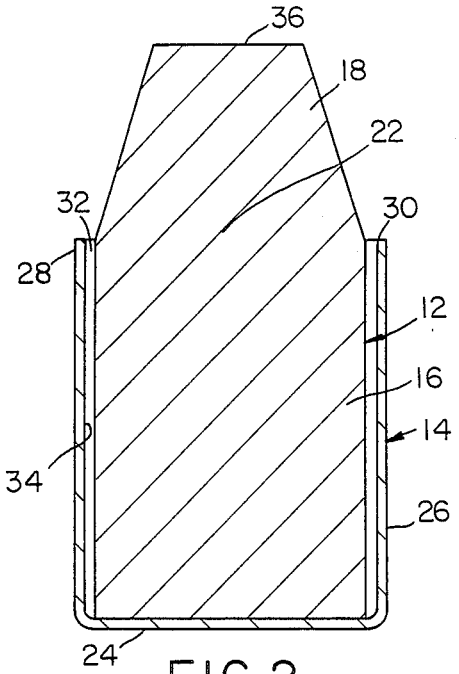
FIGS. 2 to 4 are longitudinal sectional views of the bullet after completion of successive steps in its manufacturing method which precede completion of the final step shown in FIG. 1
Figure 3:
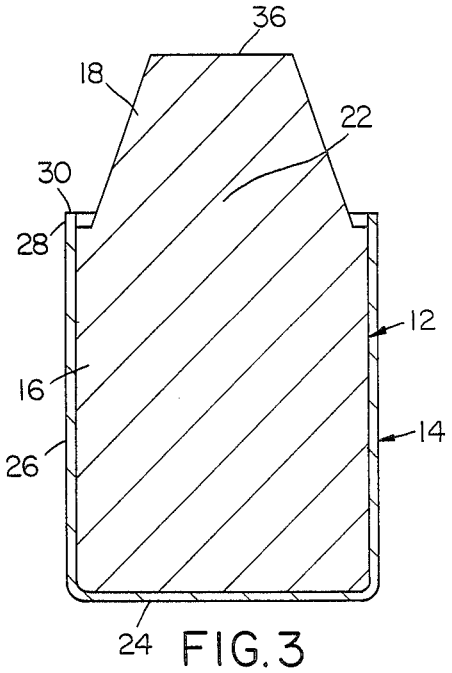
Figure 4:
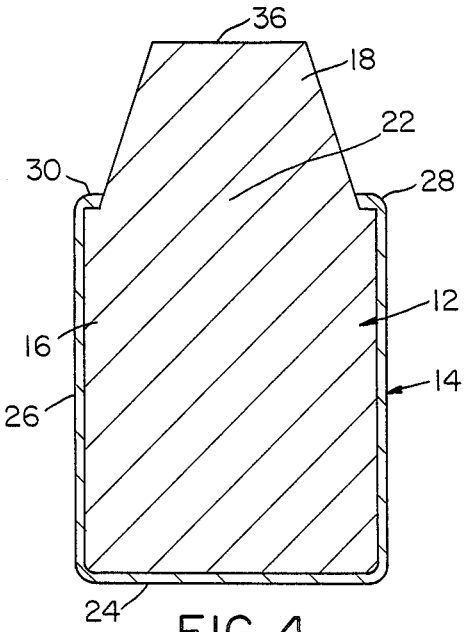

FIGS. 2 to 4 along with FIG. 1, show the sequence of steps in the semi-wadcutter bullet manufacturing method of the present invention. In FIG. 2, there is depicted the one-piece lead core 12 after being inserted into the metal cup-shaped jacket 14. The lower end of the cylindrical core body 16 rests upon the circular base 24 of the jacket 14. The height of the cylindrical jacket sidewall 26 which extends above the periphery of the base 24 is approximately the same as the height as the cylindrical section of the core body 16. Thus, an upper edge 30 on the rim portion 28 of the jacket sidewall 26 is located adjacent to the location of merger between the core body 16 and nose 18 or, in other words, the base 22 of the core nose. However, in view that the outside diameter of the core body 16 is less than the inside diameter of the jacket sidewall 26, an annular gap 32 is present therebetween which provides sufficient clearance for making it easy to place the core 12 into the jacket 14.

FIG. 3 shows the core 12 and jacket 14 after the core body 16 has been seated into conformity with an interior cavity 34 formed by the jacket sidewall 26 so as to completely fill the cavity 34 including the peripheral gap 32 therein between the exterior of the core body 16 and the interior of the jacket sidewall 26. Seating of the core body 16 within the jacket sidewall cavity 34 is brought about by use of a suitable conventional die arrangement (not shown). Compressive force is applied in an axial direction to the core 12 at its core nose 18 and to the jacket 14. The force so applied reduces the core body 16 in height to slightly less than that of the jacket sidewall 26 such that the upper edge 30 of the rim portion 28 thereof extends above the base 22 of the core nose 18. Such force also concurrently expands the core body 16 in its outside diameter to approximately that of the inside diameter of the jacket sidewall 26, snugly seating the core body 16 within the jacket sidewall cavity 34.

FIG. 4 shows the upper rim portion 28 of the jacket sidewall 26 after it has been coned radially inward toward the core nose 18 so as to place the upper edge 30 of the sidewall rim portion 28 adjacent to and into engagement with the core nose 18 just above the base 22 thereof. A suitable conventional coning die (not shown) is used to apply the force necessary to carryout coning of the annular rim portion 28.

Finally, FIG. 1 shows the final configurations of the core nose 18 and jacket sidewall rim portion 28. Another suitable conventional die arrangement (not shown) is used to applying a force to the both the core 12 and jacket 14 in an axial direction to deform the core nose 18 and jacket rim portion 28 to their respective final configurations. The compressive force so applied to the core nose 18 reduces the nose in diameter at the base 22 thereof which forms the generally radially-extending annular ledge 20 on the core body 16 and about the core nose. Concurrently, the force applied to the jacket sidewall rim portion 28 bends the coned rim portion radially inward into an overlying relation with respect to the ledge 20. The bent rim portion 28 of the jacket sidewall 26 in coaction with the jacket base 24 thus locks the jacket 14 on the core body 16 and defines the sharp annular corner 29 between the rim portion 28 and the remainder of the sidewall 26 which is displaced radially outward from the base 22 of the core nose 18.

It is thought that the present invention and many of its attendant advantages will be understood from the foregoing description and it will be apparent that various changes may be made in the form, construction and arrangement of the parts thereof without departing from the spirit and scope of the invention or sacrificing all of its manufacturing and material advantages, the form hereinbefore described being merely a preferred or exemplary embodiment thereof.

I claim:

1. A method of manufacturing a semi-wadcutter bullet, comprising the steps of:

(a) inserting a cylindrical lead core into a cup-shaped metal jacket with a continuous cylindrical sidewall having an opening of a diameter greater than the maximum diameter of the core such that a body of the core is surrounded by the sidewall of the jacket so as to define an annular gap therebetween and such that a conical nose of the core being integral with the core body protrudes beyond a rim portion of the jacket sidewall;

(b) seating the core body within the jacket sidewall so as to cause an expansion of the core body in diameter which fills the gap therebetween and a reduction of the core body in height to slightly below that of the jacket sidewall which projects the rim portion thereof slightly beyond the core body and along the core nose;

(c) deforming the core nose so as to cause a reduction of the core nose in diameter which forms an annular ledge on the core body surrounding the core nose; and (d) deforming the jacket sidewall rim portion so as to cause a bending of the sidewall rim portion into overlying relation with the ledge on the core body which locks the jacket on the core body and defines a forwardly-facing sharp corner between the rim portion and the remainder of the jacket sidewall.

2. The method as recited in claim 1, wherein said seating the core body includes applying a force to the core being so directed to concurrently cause the reduction of the core body in height to less than that of the jacket sidewall and the expansion of the core body in outside diameter to approximately that of the inside diameter of the jacket sidewall.

3. The method as recited in claim 1, wherein said deforming the jacket sidewall rim portion includes applying a force to the sidewall rim portion being so directed to cause coning thereof radially inward toward the core nose so as to place an outer edge of the sidewall rim portion adjacent to the core nose.

4. The method as recited in claim 3, wherein said deforming the core nose includes applying a force to the core nose being so directed to cause the reduction of the core nose in diameter to form the ledge on the core body surrounding the core nose.

5. The method as recited in claim 4, wherein said deforming the jacket sidewall rim portion further includes applying a force to the coned sidewall rim portion being so directed to cause the bending of the sidewall rim portion into overlying relation with the ledge on the core body to lock the jacket on the core body and define the sharp corner between the rim portion and the remainder of the jacket side. wall.

6. The method as recited in claim 1, wherein said deforming the core nose and the jacket sidewall rim portion includes applying a force to the core nose and sidewall rim portion being so directed to concurrently cause the reduction of the core nose in diameter to form the ledge on the core body surrounding the core nose and the bending of the sidewall rim portion into overlying relation with the ledge on the core body to lock the jacket on the core body and define the sharp corner between the rim portion and the remainder of the jacket side-wall.

7. A method of manufacturing a semi-wadcutter bullet, comprising the steps of:

(a) inserting a lead core into a metal jacket such that a body of the core is surrounded by a continuous sidewall of the jacket with a rim diameter greater than the maximum diameter of the core so as to define an annular gap therebetween and such that a conical nose of the core being integral with the core body protrudes beyond a rim portion of the jacket sidewall;

(b) seating the core body within the jacket sidewall by applying a force to the core being so directed to concurrently cause an expansion of the core body in outside diameter to approximately that of the inside diameter of the jacket sidewall which fills the gap therebetween and a reduction of the core body in height to slightly below that of the jacket sidewall which projects the rim portion thereof slightly beyond the core body and along the core nose;

(c) deforming the jacket sidewall rim portion by applying a force thereto being so directed to cause coning thereof radially inward toward the core nose so as to place an outer edge of the sidewall rim portion adjacent to the core nose; and (d) deforming the core nose and jacket sidewall rim portion by applying a force thereto being so directed to concurrently cause a reduction of the core nose in diameter which forms an annular ledge on the core body surrounding the core nose and a bending of the coned sidewall rim portion into overlying relation with the ledge on the core body which locks the jacket on the core body and defines a forwardly-facing sharp corner between the rim portion and the remainder of the jacket sidewall.

8. A semi-wadcutter bullet for target practice, comprising:

(a) a core having a bore, nose and forwardly-facing annular ledge on said body surrounding a base of said nose and extending generally radially outwardly therefrom; and (b) a metal cup-shaped jacket which encloses said core body up to and including said annular ledge, said jacket having a rim portion which is bent over and extends radially inward in overlying relation with said ledge to lock said jacket on said core body and define a sharp profile for making clean cut holes in target.

9. A semi-wadcutter bullet, comprising:

(a) a lead core having a cylindrical body, a frusto-conical nose being formed integral with said body and extending forwardly therefrom, and a forward-facing annular ledge formed on said body and surrounding a base of said nose;

(b) a metal jacket having a cylindrical sidewall with an annular rim portion thereon;

(c) said core body being seated within the jacket sidewall with said core nose protruding thereabove;

(d) said rim portion of said jacket sidewall being bent into overlying relation with said ledge on said core body so as to lock said jacket on said core body and define a forwardly-facing sharp corner between said sidewall rim portion and the remainder of said jacket sidewall.

10. The bullet as recited in claim 8, wherein said jacket is cup-shaped.

* * * * *

UNITED STATES PATENT AND TRADEMARK OFFICE

CERTIFICATE OF CORRECTION

PATENT NO. : 4,805,536

DATED : February 21, 1989

INVENTOR(S) : Gregory R. Kosteck

It is certified that error appears in the above—identified patent and that said Letters Patent is hereby corrected as shown below:

In Column 6, at line 31, delete the word "bore" and insert the word --body--.

Signed and Sealed this

Eleventh Day of February, 1992

*Attest:*

HARRY F. MANBECK, JR.

*Attesting Officer*

*Commissioner of Patents and Trademarks*